US011745512B2

(12) United States Patent
Kawate et al.

(10) Patent No.: US 11,745,512 B2
(45) Date of Patent: Sep. 5, 2023

(54) INK SUPPLY CONTAINER AND METHOD OF REPRODUCING THE INK SUPPLY CONTAINER

(71) Applicant: SEIKO EPSON CORPORATION, Tokyo (JP)

(72) Inventors: Hiroyuki Kawate, Hokuto (JP); Noriyuki Fukasawa, Matsumoto (JP); Atsushi Kobayashi, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 72 days.

(21) Appl. No.: 17/368,573

(22) Filed: Jul. 6, 2021

(65) Prior Publication Data

US 2022/0009239 A1 Jan. 13, 2022

(30) Foreign Application Priority Data

Jul. 7, 2020 (JP) ..... 2020-116913

(51) Int. Cl.
*B41J 2/175* (2006.01)

(52) U.S. Cl.
CPC ..... *B41J 2/17513* (2013.01); *B41J 2/17523* (2013.01)

(58) Field of Classification Search
CPC ..... B41J 2/17513; B41J 2/17523; B41J 2002/17516; B41J 2/1754; B41J 29/13; B41J 2/17509; B41J 2/17506
USPC ..... 347/86
See application file for complete search history.

(56) References Cited

U.S. PATENT DOCUMENTS

2006/0017788 A1* 1/2006 Otis ..... B41J 2/17513 347/85
2018/0207939 A1* 7/2018 Ishizawa ..... B41J 2/17509

FOREIGN PATENT DOCUMENTS

JP H07-033828 U 6/1995
JP 2018-118453 A 8/2018

* cited by examiner

*Primary Examiner* — Matthew Luu
*Assistant Examiner* — Alexander D Shenderov
(74) *Attorney, Agent, or Firm* — Oliff PLC

(57) ABSTRACT

An ink supply container configured to supply an ink to a printer includes a container part configured to contain the ink, a conduit part on a top side of the container part, the conduit part being configured to lead the ink out, a cap configured to protect the conduit part, the cap being detachably attached to the conduit part, and a film attached to at least one of an inner surface of the container part, an inner surface of the conduit part, and an inner surface of the cap.

6 Claims, 13 Drawing Sheets

INK SUPPLY CONTAINER AND METHOD OF REPRODUCING THE INK SUPPLY CONTAINER

The present application is based on, and claims priority from JP Application Serial Number 2020-116913, filed Jul. 7, 2020, the disclosure of which is hereby incorporated by reference herein in its entirety.

BACKGROUND

1. Technical Field

The present disclosure relates to an ink supply container.

2. Related Art

Ink jet printers that discharge an ink from a print head onto a print medium such as printing paper to print on the print medium with the ink are known as examples of ink ejecting apparatuses. Such ink jet printers include ink-supply-type printers that have an ink tank to which an ink is supplied and that use the ink. For example, JP-A-2018-118453 discloses an ink-supply-type ink bottle and a bottle set with improved convenience.

In reusing the ink bottle, however, due to the ink adhering to all components of the used ink bottle, it is difficult to reuse such an ink bottle. In addition, the use of a reused bottle is limited. If all of the components of the ink bottle are to be discarded, the volume of the components to be discarded is large.

SUMMARY

According to an aspect of the present disclosure, an ink supply container is provided. The ink supply container is an ink supply container configured to supply an ink to a printer and includes a container part configured to contain the ink, a conduit part located on a top side of the container part, the conduit part being configured to lead the ink out, a cap configured to protect the conduit part, the cap being detachably attached to the conduit part, and a film attached to at least one of an inner surface of the container part, an inner surface of the conduit part, and an inner surface of the cap.

DESCRIPTION OF EXEMPLARY EMBODIMENTS

A. First Embodiment

A1. Apparatus Structure

Figure 1:
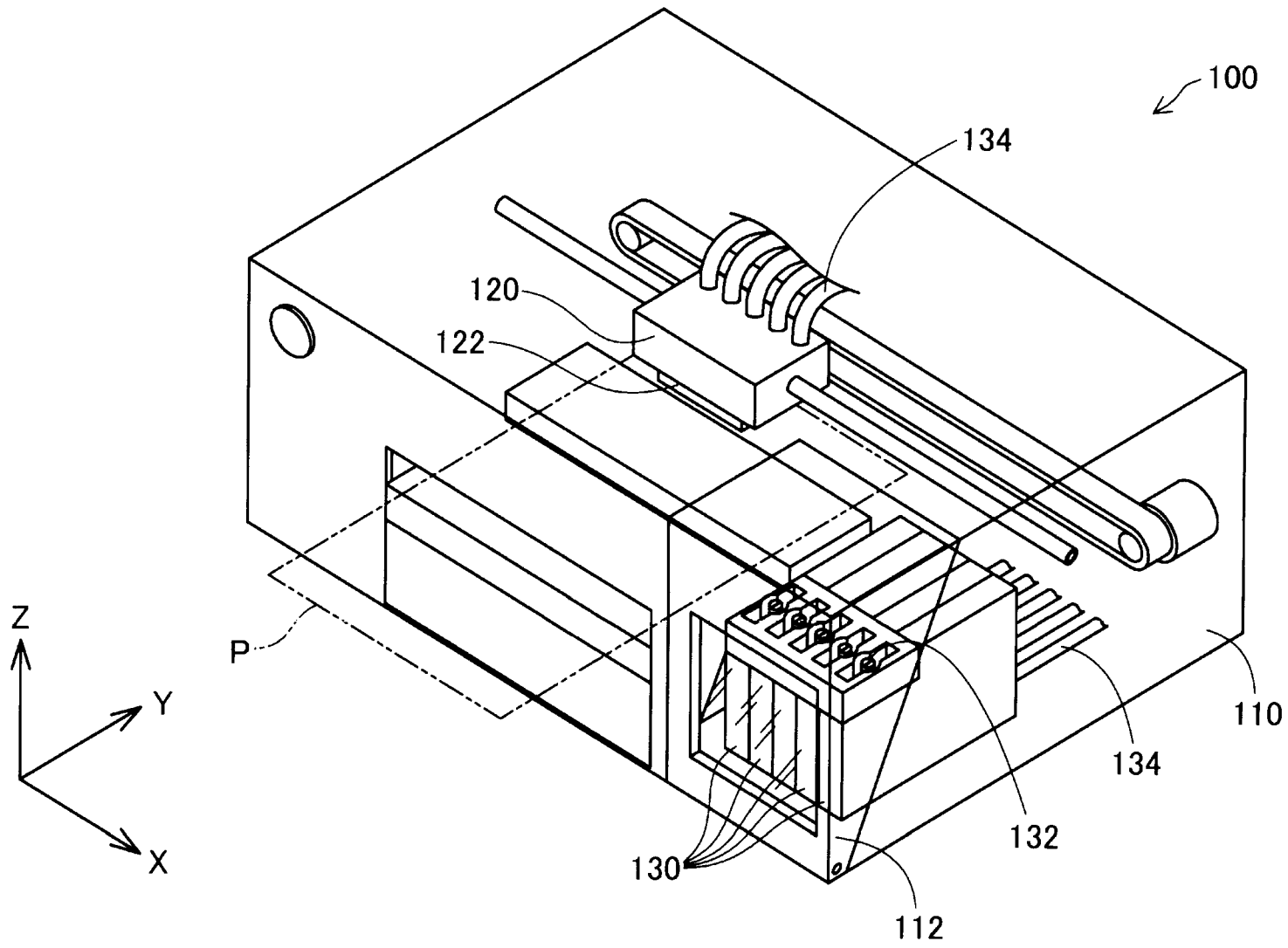
FIG. 1 is a perspective view of a printer to which an ink is supplied from an ink supply container according to an embodiment of the present disclosure.

FIG. 1 is a perspective view of a printer 100 to which an ink is supplied from an ink supply container 200 according to an embodiment of the present disclosure. The printer 100 is an ink jet printer that performs printing by discharging an ink onto a print medium P. FIG. 1 illustrates an X-axis, a Y-axis, and a Z-axis that are orthogonal to each other. The X-axis corresponds to a width direction of the printer 100, the Y-axis corresponds to a depth direction of the printer 100, and the Z-axis corresponds to a height direction of the printer 100. The printer 100 is installed on a horizontal installation surface that is defined by an X-axial direction and a Y-axial direction. The "X-axial direction" according to the embodiment collectively refers to a positive X direction and a negative X direction. Similarly, the "Y-axial direction" collectively refers to a positive Y direction and a negative Y direction, and the "Z-axial direction" collectively refers to a positive Z direction and a negative Z direction.

The printer 100 includes a housing 110. A carriage 120 that can be moved in a main scanning direction (X-axial direction) is disposed in the housing 110. A print head 122 that discharges an ink onto a print medium P is disposed on a lower surface of the carriage 120. An openable/closable cover 112 is disposed at one end on a front of the housing 110. A plurality of ink tanks 130 are disposed behind the cover 112.

The ink tanks 130 are coupled to the print head 122 on the carriage 120 via tubes 134. The ink in each ink tank 130 is supplied through the tube 134 to the print head 122. The ink tanks 130 are ink-supply-type ink tanks. Each ink tank 130 has in its upper surface a cylindrical ink inlet flow channel member 132 for supplying an ink into the ink tank 130. These ink tanks 130 are fixed-type ink tanks that are not mounted on the carriage 120. The front surface of each ink tank 130 is made of an optically transparent member, and an ink level in each ink tank 130 is visible from the outside. When an ink level is low, the cover 112 can be opened and the ink can be supplied through the ink inlet flow channel member 132 of the ink tank 130.

In the specification, the expression "supply an ink" means to supply or refill an ink into the ink tank 130 to raise the ink level. It should be noted that "supply an ink" does not necessarily mean to fill the ink tank 130 to a full level of capacity with the ink. In addition, "supply an ink" includes an operation of filling an empty ink tank 130 with ink on the initial use of the printer 100.

Figure 2:
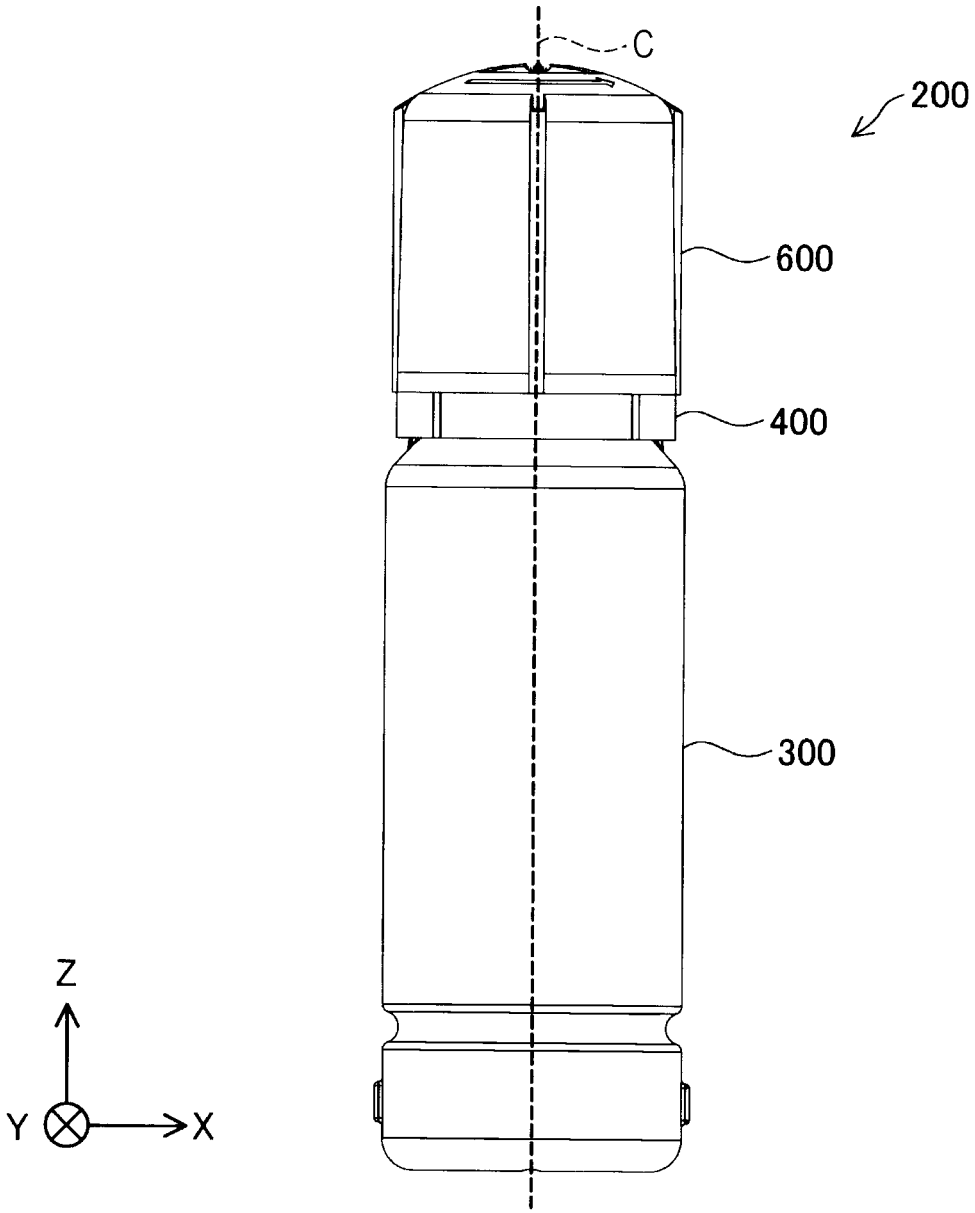
FIG. 2 is a front view of an ink supply container that is in an upright state.

FIG. 2 is a front view of the ink supply container 200 that is in an upright state. The expression "the ink supply container 200 that is in an upright state" means that a container body 300 is disposed on a horizontal plane, such as a desk, with its bottom facing down. An upper portion of the ink supply container 200 in the upright state is referred to as a "top" and a lower portion is referred to as a "bottom". FIG. 2 and subsequent drawings illustrate the positive Z direction that denotes a vertically upward direction in a state in which the ink supply container 200 is in the upright state. FIG. 2 illustrates with a broken line a central axis C of the ink supply container 200. A direction parallel to the central axis C of the ink supply container 200 herein is referred to as an "axial direction", and a direction orthogonal to the central axis C is referred to as a "radial direction".

The ink supply container 200 includes the container body 300 that contains an ink, a conduit part 400 that functions as an ink outlet 415, which will be described below, and a cap 600 that is detachably attached to the top of the conduit part 400.

Before ink is supplied, an ink is contained in the ink supply container 200. The user opens the cover 112 illustrated in FIG. 1 to expose the ink tank 130. The user removes the cap 600 of the ink supply container 200. The user inverts the ink supply container 200, from which the cap 600 has been removed, and supplies the ink into the ink tank 130. In this embodiment, the amount of ink contained in the ink supply container 200 is greater than that required to fill the ink tank 130. Accordingly, after the ink is supplied multiple times from the ink supply container 200 into the ink tank 130, the ink in the ink supply container 200 is substantially depleted.

Figure 3:
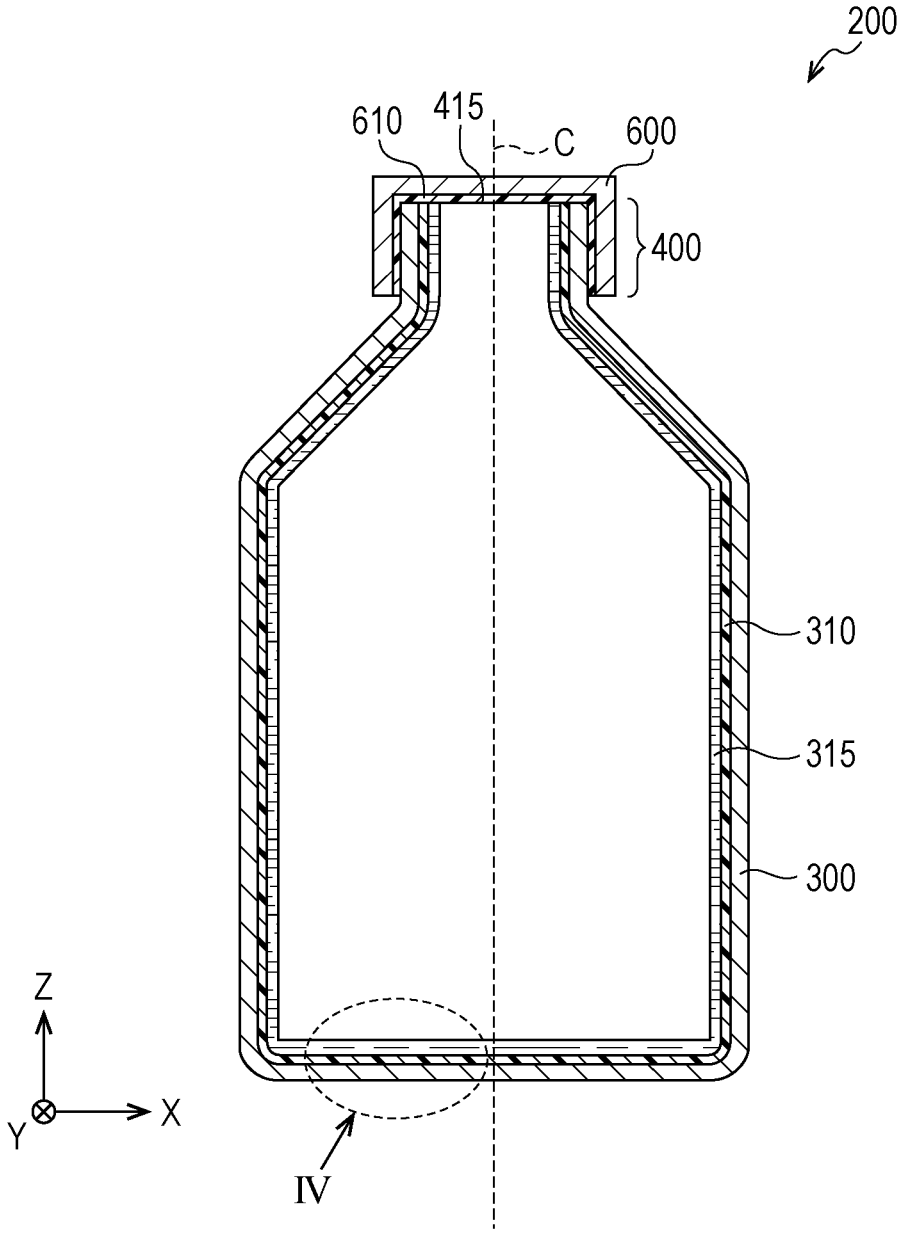
FIG. 3 is a sectional view illustrating a schematic structure of an ink supply container from which an ink has been depleted.

FIG. 3 is a sectional view illustrating a schematic structure of the ink supply container 200 from which the ink has been depleted. The expression "ink has been depleted" means that the ink contained in the container body 300 has substantially been depleted after multiple operations of supplying ink to the above-described ink tank 130 have been performed. Such an ink supply container 200 from which the ink has been depleted is hereinafter referred to as a "used container 200". FIG. 3 illustrates a section that includes the central axis C. The container body 300 has the conduit part 400 that has an opening on the top. A film 310 is attached to an inner surface of the container body 300. The container body 300 can contain an ink by using the film 310. A film 610 is attached to an inner surface of the cap 600, which will be described below.

Figure 4:
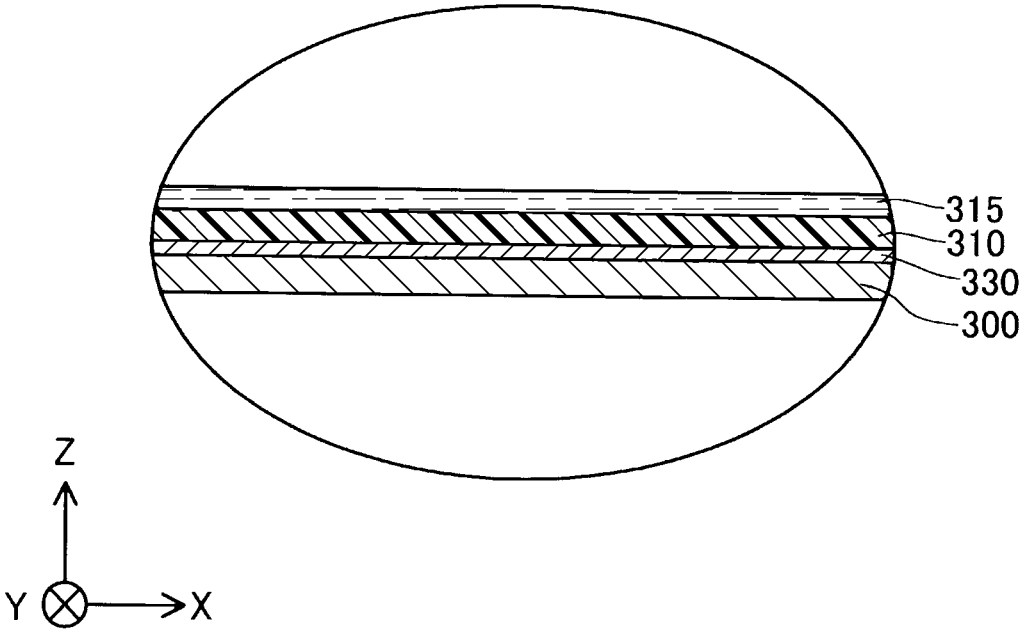
FIG. 4 is an enlarged view illustrating an area illustrated in FIG. 3.

FIG. 4 is an enlarged view illustrating area IV illustrated in FIG. 3. The inner surface of the container body 300 is water repellent. More specifically, a water-repellent layer 330 is provided between the container body 300 and the film 310.

The film 310 according to the embodiment enables an ink to be contained. The film 310 is sized to be within the container body 300. As described above, the film 310 is attached to the inner surface of the container body 300. The attached film 310 prevents or reduces adhesion of ink to the inner surface of the container body 300. FIG. 3 illustrates residual ink 315 adhering to the inside of the film 310 after use.

The film 310 according to the embodiment is made of acrylic synthetic resin. The film 310 is not limited to acrylic synthetic resin, and may be composed of a synthetic resin of nitrocellulose, polyamide, cyclized rubber, chlorinated rubber, urethane, or poval, or a synthetic resin consisting of a mixture of two or more of such synthetic resins.

The conduit part 400 is at the top of the container body 300 as illustrated in FIG. 3. A valve unit (not illustrated) is attached to the inside of the conduit part 400. The top of the conduit part 400 in the positive Z direction is an ink outlet 415. A central axial direction of the ink outlet 415 herein corresponds to the direction of the central axis C of the ink supply container 200. The expression "the central axial direction of the ink outlet 415" means a vertical direction through a center of the ink outlet 415 with respect to a virtual plane parallel to the ink outlet 415. The central axial direction of the ink outlet 415 and the direction of the central axis C may be offset from each other. Note that the valve unit may be omitted. For example, a container from which an ink is depleted in a single ink supply operation may be sealed with a sealing member such as a film at the ink outlet 415, and the ink outlet 415 may be opened by peeling or cutting.

The conduit part 400 has a valve (not illustrated) to open or close the ink outlet 415. The conduit part 400 leads an ink out when the ink outlet 415 is open. The conduit part 400 does not lead an ink out when the ink outlet 415 is closed. As will be described below, in reproducing the ink supply container 200, the ink outlet 415 is open and an ink is introduced through the conduit part 400 into the container body 300. As described above, the film 310 is attached to the inner surface of the container body 300, and the film 310 is also attached to an inner surface of the conduit part 400 that is a part of the container body 300. As described above, the inner surface of the container body 300 is water repellent, and the inner surface of the conduit part 400, which is a part of the container body 300, is also water repellent. It should be noted that the conduit part 400 may be provided separately from the container body 300 and may be coupled to the container body 300. In such a case, the film 310 is similarly attached to the inner surface of the conduit part 400 that comes into contact with the ink.

The conduit part 400 is surrounded by a convex fitting part (not illustrated) when viewed from the ink outlet 415 side. The fitting part is shaped so as to be fitted into a concave part of the ink tank 130 provided around the ink inlet flow channel member 132. In this embodiment, two fitting parts are provided at positions across the ink outlet 415. The two fitting parts have point symmetry about the central axis C of the ink supply container 200 at an angle of 180 degrees. Similarly, the concave parts, which are provided around the ink inlet flow channel member 132 of the ink tank 130, have point symmetry about the ink inlet flow channel member 132 at an angle of 180 degrees. In supplying ink, the fitting parts of the ink supply container 200 are fitted into the concave parts around the ink inlet flow channel member 132 of the ink tank 130, thereby limiting the orientations of the ink supply container 200 to two orientations that have point symmetry with an angle of 180 degrees. With this structure, the ink supply container 200 can be held in a stable orientation when supplying ink. It should be noted that the fitting parts may be omitted.

As illustrated in FIG. 3, the cap 600 is attached to the top of the conduit part 400. The cap 600 has a cylindrical shape enclosed at the top. The cap 600 is placed over the conduit part 400 such that the top is located in the positive Z direction. The cap 600 has a function of protecting the conduit part 400 and can be detachably attached to the conduit part 400. The inner surface of the cap 600 is made to be water repellent and has a water-repellent layer (not illustrated). The film 610 is attached to the inner surface of the cap 600. The film 610 is made of the same material as the film 310, and accordingly, detailed description thereof is omitted.

A2. Reproducing Method

Figure 5:
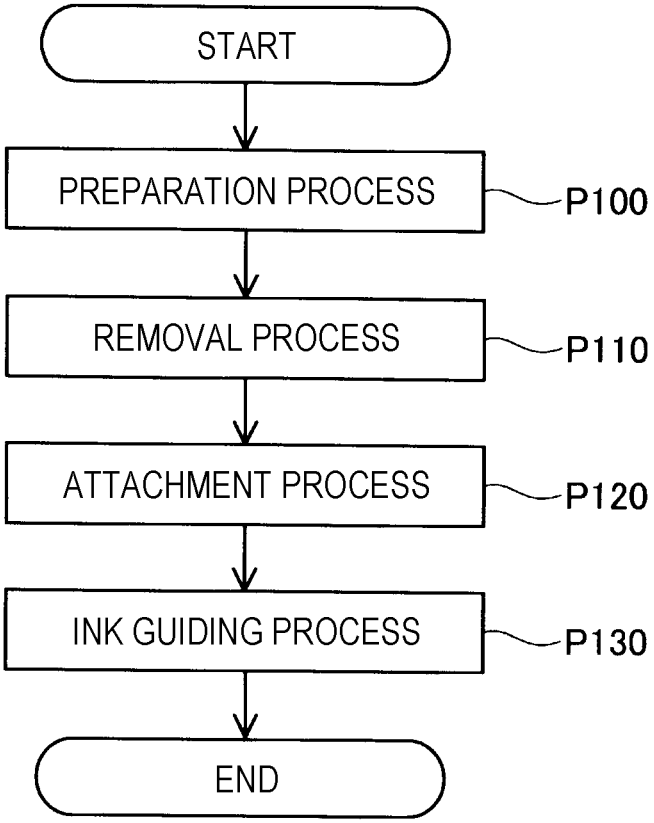
FIG. 5 is a flowchart illustrating a first method of reproducing an ink supply container.

FIG. 5 is a flowchart illustrating a first method of reproducing an ink supply container 200. The expression "reproducing an ink supply container 200" herein means removing the residual ink 315 from a used container 200 and refilling the container body 300 with a new ink, thereby producing the ink supply container 200 that can supply the ink to the printer 100.

The used container 200 from which the ink has been supplied to the printer 100 and depleted is prepared (process P100). In process P100, the ink supply container 200 illustrated in FIG. 3 is prepared as the used container 200.

Air is blown into the used container 200 between the film 310 and the inner surfaces of the container body 300 and the conduit part 400, thereby peeling off and removing the film 310 (process P110). The removal process is described with reference to FIG. 6 to FIG. 8. Note that the film 610 is similarly stripped and removed from the cap 600 by blowing air between the film 610 and the inner surface of the cap 600.

Figure 6:
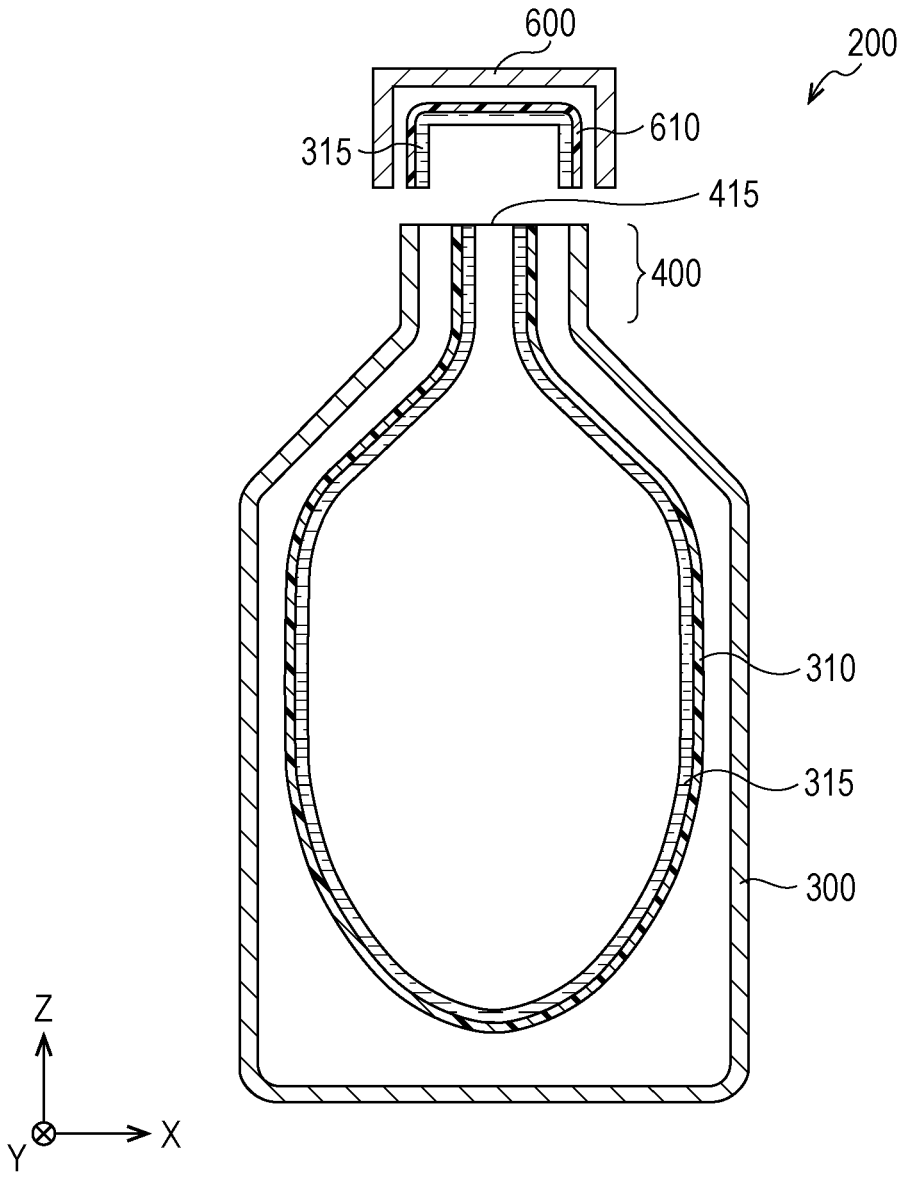
FIG. 6 is a sectional view illustrating a used container from which a film is peeled off.

FIG. 6 is a sectional view illustrating the used container 200 from which the film is peeled off. As illustrated in FIG. 6, after process P110 is completed, the film 310 is stripped from the inner surface of the container body 300 and the inner surface of the conduit part 400. The film 610 is also stripped from the inner surface of the cap 600. The used container 200 illustrated in FIG. 6 is provided after the above-described air blowing.

Figure 7:
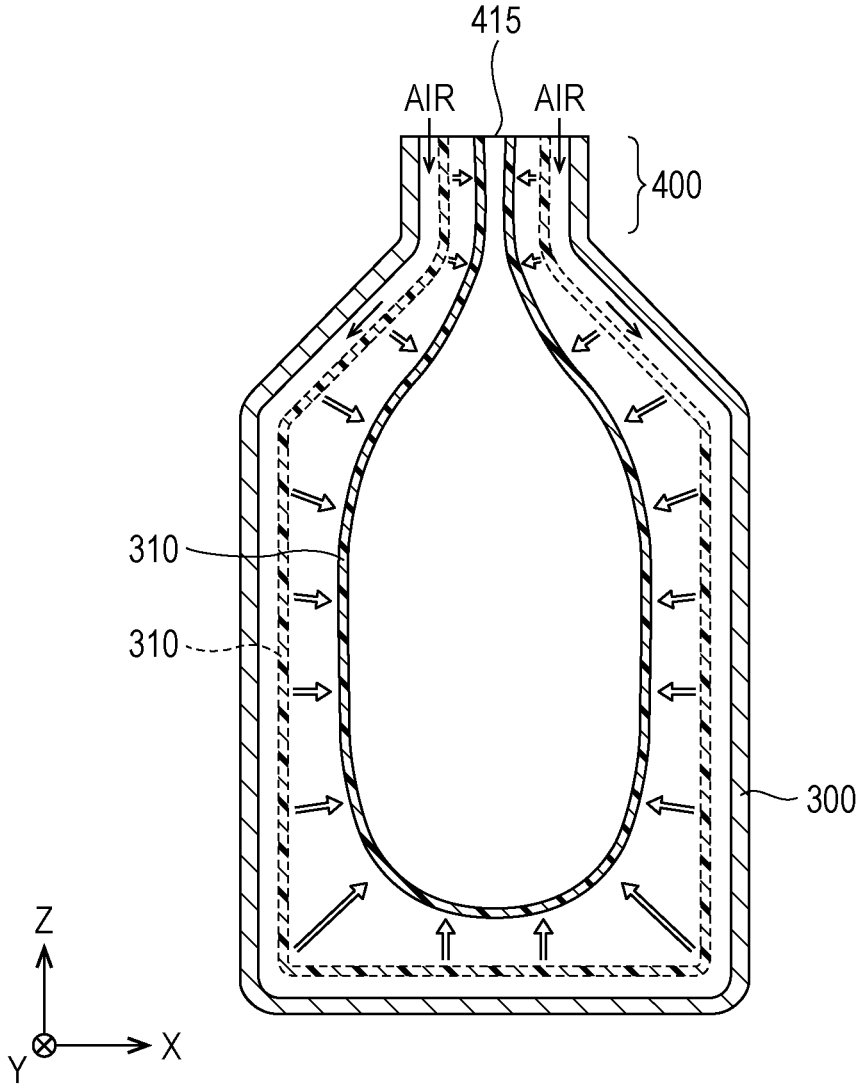
FIG. 7 illustrates a process of peeling off a film.

FIG. 7 illustrates a process of stripping the film 310. As illustrated in FIG. 7, air is blown from the ink outlet 415 in the negative Z direction between the film 310 and the inner surfaces of the conduit part 400 and the container body 300. The air pressure peels off the film 310 attached to the inner surface of the conduit part 400 and the inner surface of the container body 300. Although FIG. 7 omits the cap 600, air is similarly blown between the film 610 and the inner surface of the cap 600, thereby stripping the film 610. The water-repellent layer has been formed by water-repellent processing between the film 310 and the inner surfaces of the container body 300 and the conduit part 400. In addition, the water-repellent layer has been formed by the water-repellent processing also between the film 610 and the inner surface of the cap 600 (not illustrated). With this structure, the film 310 and the film 610 can be readily stripped by air blowing. As illustrated in FIG. 7, the stripped film 310 gradually shrinks and decreases in volume.

Figure 8:
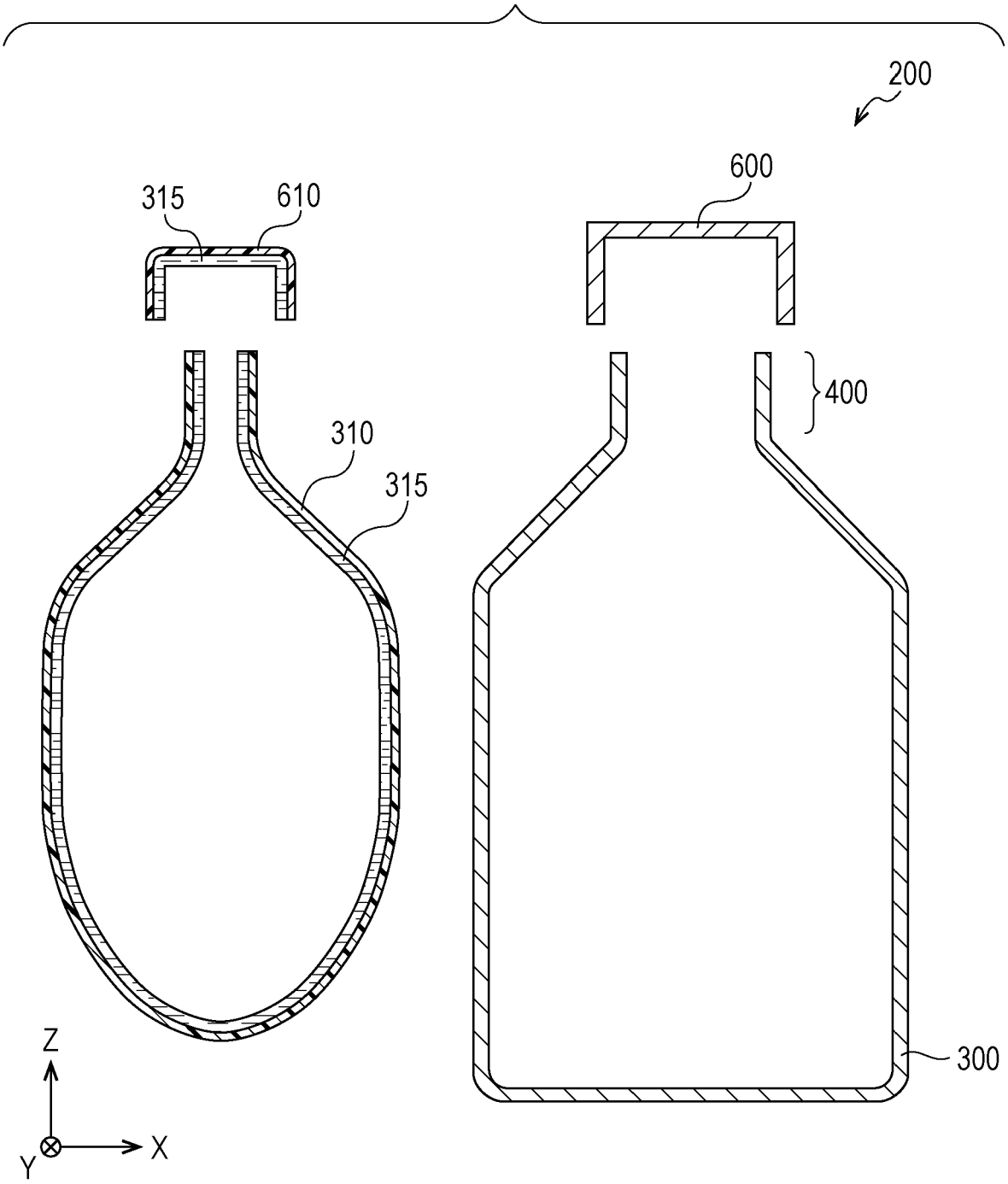
FIG. 8 is a sectional view illustrating a removed film and a used container.

FIG. 8 is a sectional view illustrating the removed films 310 and 610 and the used container 200. Before the process in step P110 is performed, the residual ink 315 in the used container is in a state of adhering to the inner surface of the film 310 and the inner surface of the film 610. In process P110, the shrunk film 310 is pulled out of the container body 300 through the opening of the conduit part 400 and separated. The film 610 on the inner surface of the cap 600 is similarly pulled out of the cap 600 and separated. Before process P110, the residual ink 315 in the used container 200 is in a state of adhering to the inner surface of the film 310 and the inner surface of the film 610 only. Accordingly, by separating the film 310 and the film 610 from the used container 200, all of the residual ink 315 is removed from the used container 200 and no residual ink 315 remains adhered to the used container 200, and thus the used container 200 can be reused. In addition, the separation reduces the volume of the components to be discarded compared with a case in which all components are to be discarded without separation.

Figure 9:
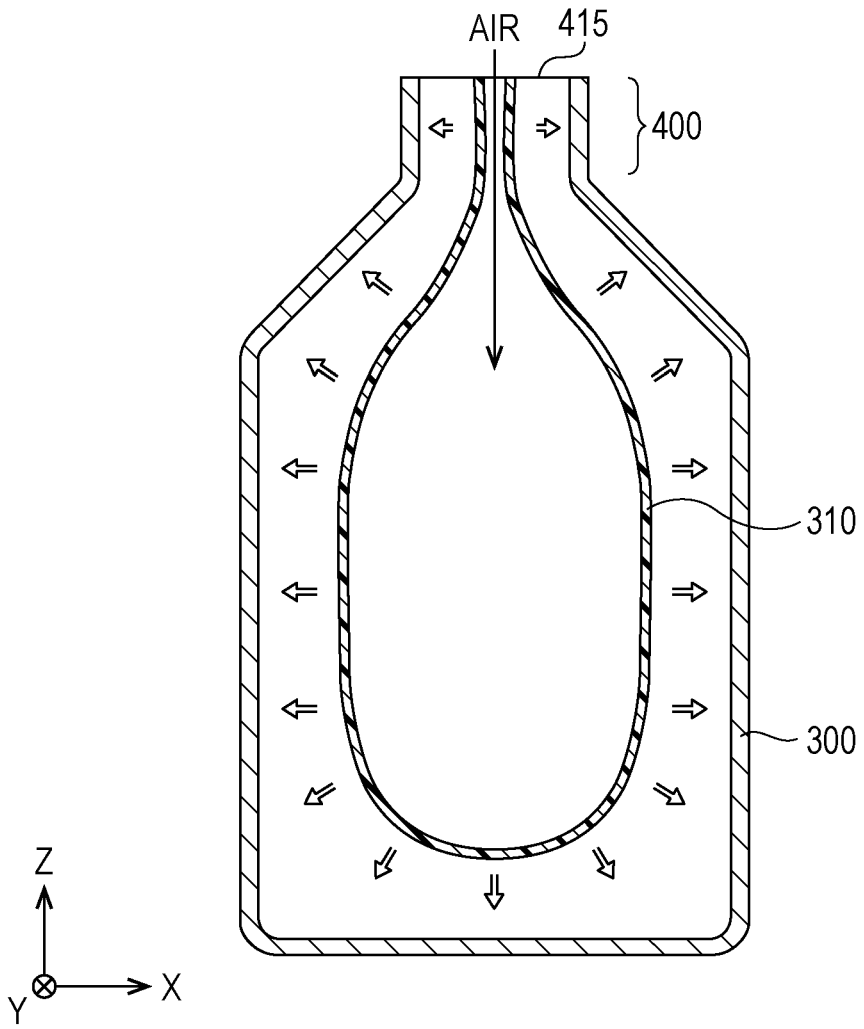
FIG. 9 illustrates a process of attaching a new film.

As illustrated in FIG. 5, a new film is attached (process P120). FIG. 9 illustrates a process of attaching a new film. In process P120, a new film 310 is inserted into the container body 300 through the opening of the conduit part 400, and air is then blown onto the film 310 inside. The processing applies air pressure and expands the film 310, attaching the new film 310 to the inside of the container body 300 and the inner surface of the conduit part 400. Note that in the cap 600, a new film 610 is similarly attached to the inner surface of the cap 600.

As illustrated in FIG. 5, an ink is introduced into the interior of the container body 300 (process P130) through the conduit part 400. The cap 600 is attached to the container body 300 and the processing of reproducing the ink supply container 200 is completed.

The container body 300 according to the embodiment corresponds to a container part in Claims.

The ink supply container 200 according to the first embodiment is provided with the film 310 that is attached to both the inner surface of the container body 300 and the inner surface of the conduit part 400. In addition, the film 610 is attached to the inner surface of the cap 600. After the ink is depleted, the film 310 and the film 610 with the adhering residual ink 315 can be stripped and removed from the inner surfaces, enabling the container body 300, the conduit part 400, and the cap 600 with no residual ink 315 to be reused. With this structure, the reuse of the ink supply container 200 can be eased and a reduction in the volume of the components to be discarded can be achieved.

The ink supply container 200 according to the first embodiment is subjected to water-repellent processing and the water-repellent layer is formed between the film 310 and the inner surfaces of the container body 300 and the conduit part 400. In addition, the water-repellent layer is also formed by the water-repellent processing between the film 610 and the inner surface of the cap 600. With this structure, the film 310 and the film 610 can be readily stripped by the air blowing processing in process P110.

B. Second Embodiment

Figure 10:
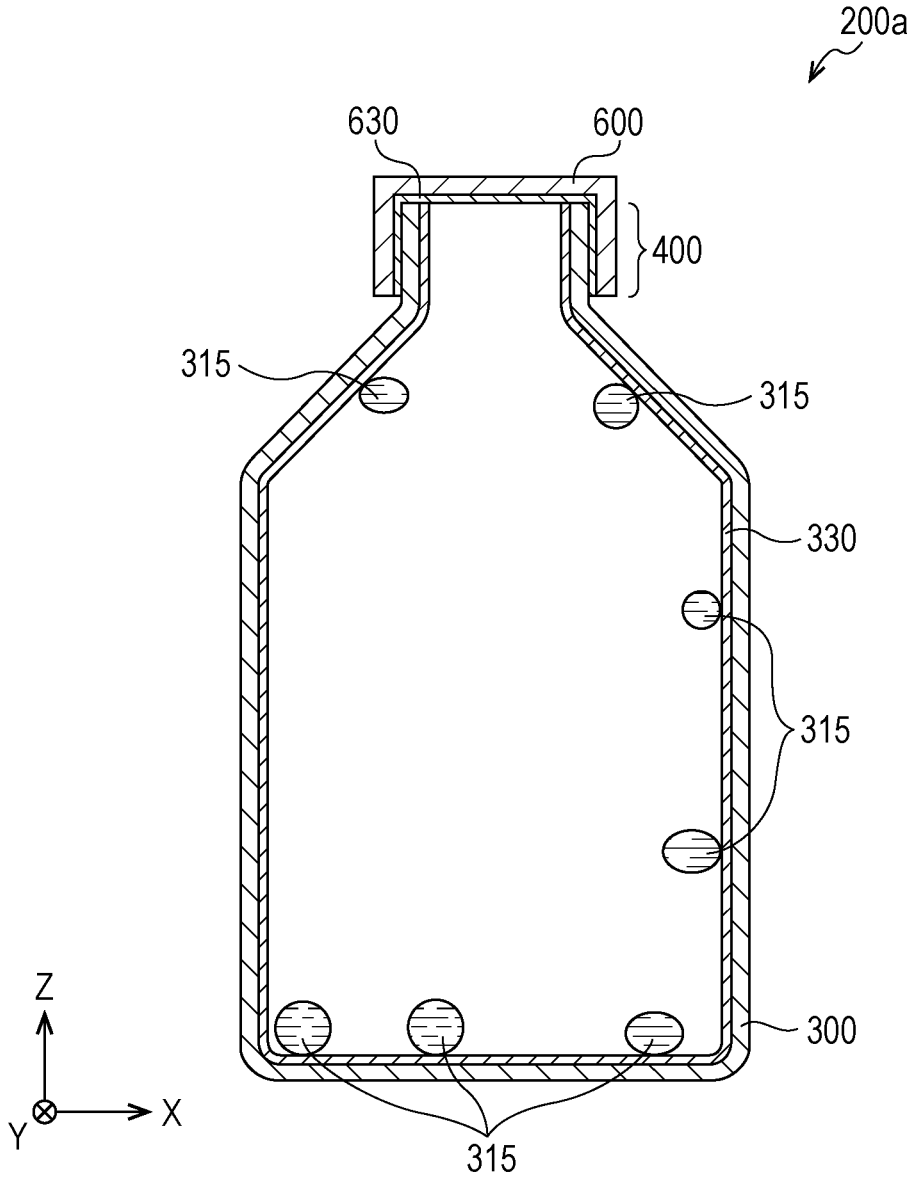
FIG. 10 is a sectional view illustrating a schematic structure of an ink supply container from which an ink has been depleted according to a second embodiment.

FIG. 10 is a sectional view illustrating a schematic structure of an ink supply container 200*a* from which an ink has been depleted according to a second embodiment. The ink supply container 200*a* according to the second embodiment differs from the ink supply container 200 according to the first embodiment in that the film is not provided to all the inner surface of the container body 300, the inner surface of the conduit part 400, and the inner surface of the cap 600. In addition, processes in reproducing the ink supply container 200*a* according to the second embodiment differ from the processes in reproducing the ink supply container 200 according to the first embodiment. Other structures of the ink supply container 200*a* according to the second embodiment are similar to those of the ink supply container 200 according to the first embodiment and thus, the same reference numerals are given to components similar to those in the first embodiment and detailed description thereof is omitted.

As illustrated in FIG. 10, the water-repellent layer 330 has been formed by water-repellent processing on the inner surface of the container body 300 and the inner surface of the conduit part 400. The inner surface of the cap 600 is also subjected to the water-repellent processing and a water-repellent layer 630 is formed. In the ink supply container 200*a* according to the second embodiment, neither of the films 310 and 610 that are attached to the ink supply container 200 according to the first embodiment are attached.

Figure 11:
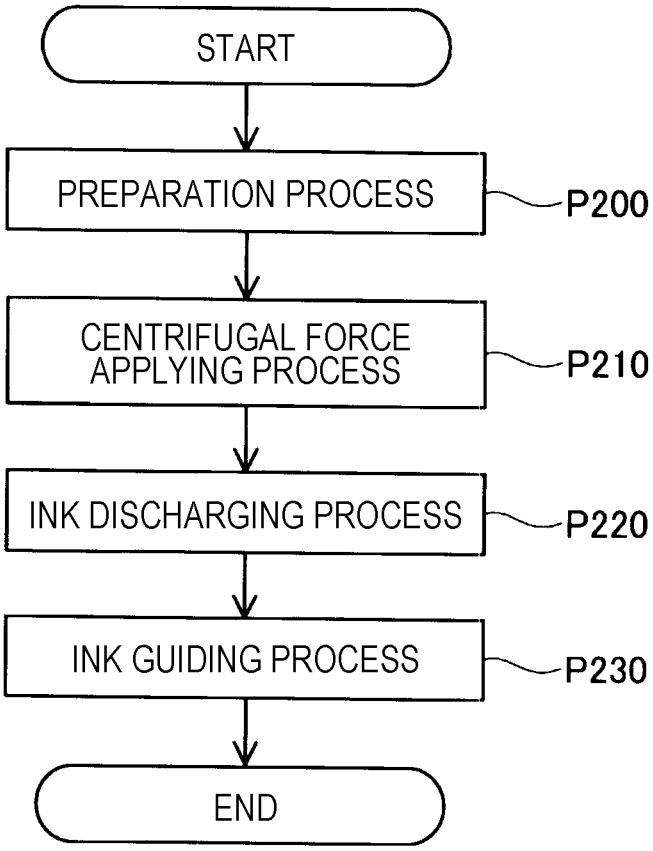
FIG. 11 is a flowchart illustrating a second method of reproducing an ink supply container.

FIG. 11 is a flowchart illustrating a second method of reproducing an ink supply container 200*a*. The used container 200*a* from which the ink has been supplied to the printer 100 and depleted is prepared (process P200). In process P200, the ink supply container 200*a* illustrated in FIG. 10 is prepared as the used container 200*a*.

As illustrated in FIG. 10, the residual ink 315 is gathered together by the water-repellent layer 330 and adheres to the water-repellent layer 330 on the inner surface of the container body 300.

Figure 12:
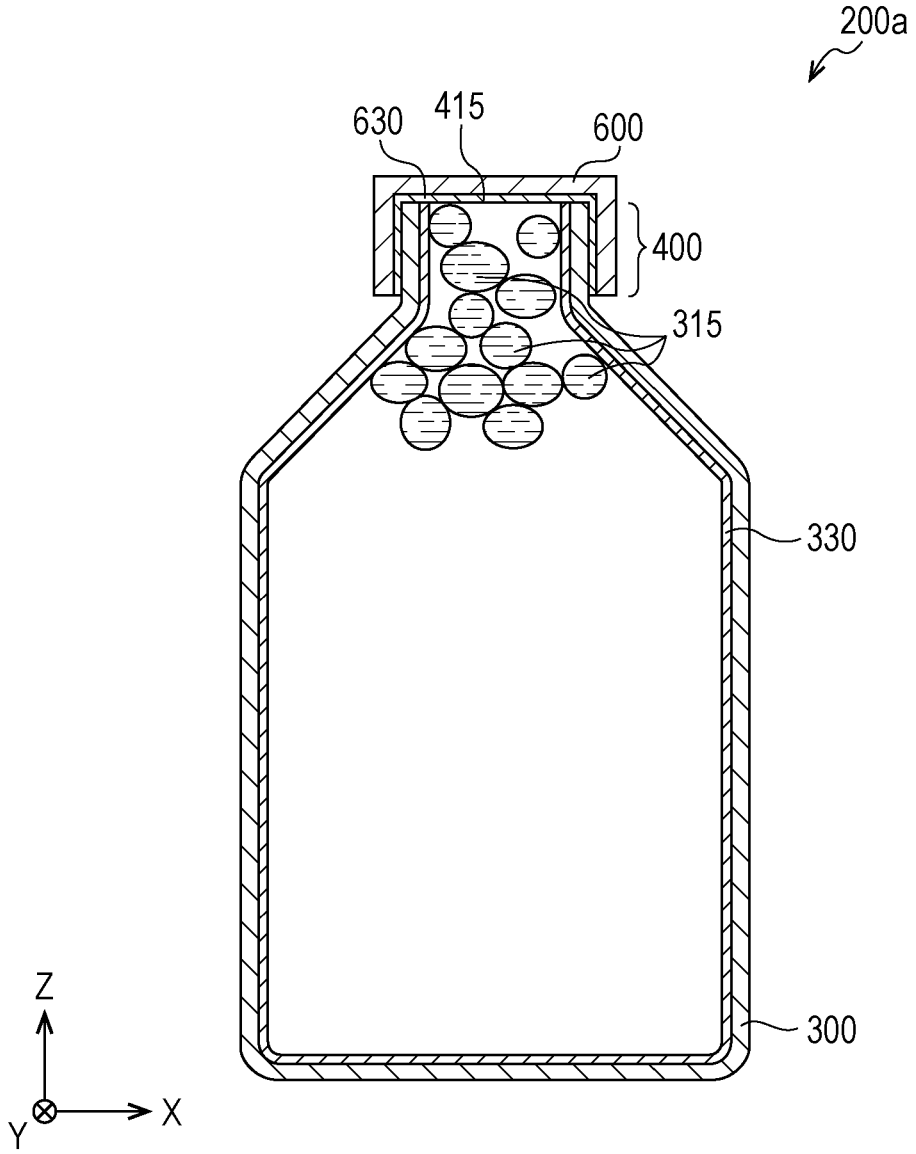
FIG. 12 is a sectional view schematically illustrating a state of residual ink in the ink supply container after application of centrifugal force.

A centrifugal force is applied to the ink supply container 200*a* with the cap 600 attached to the conduit part 400 (process P210). More specifically, the ink supply container 200*a* is set in a centrifuge (not illustrated). In this operation, the ink supply container 200*a* is set such that the conduit part 400 faces outward in the radial direction of a rotor of the centrifuge. With this setting, in response to an operation of the centrifuge, the residual ink 315 moves toward the conduit part 400. FIG. 12 is a sectional view schematically illustrating a state of the residual ink 315 in the ink supply container 200*a* after the application of centrifugal force. The dotted residual ink 315 is gathered toward and nearby the conduit part 400 by the process in process P210. By the processing, the residual ink 315 can be readily discharged from the container body 300.

Figure 13:
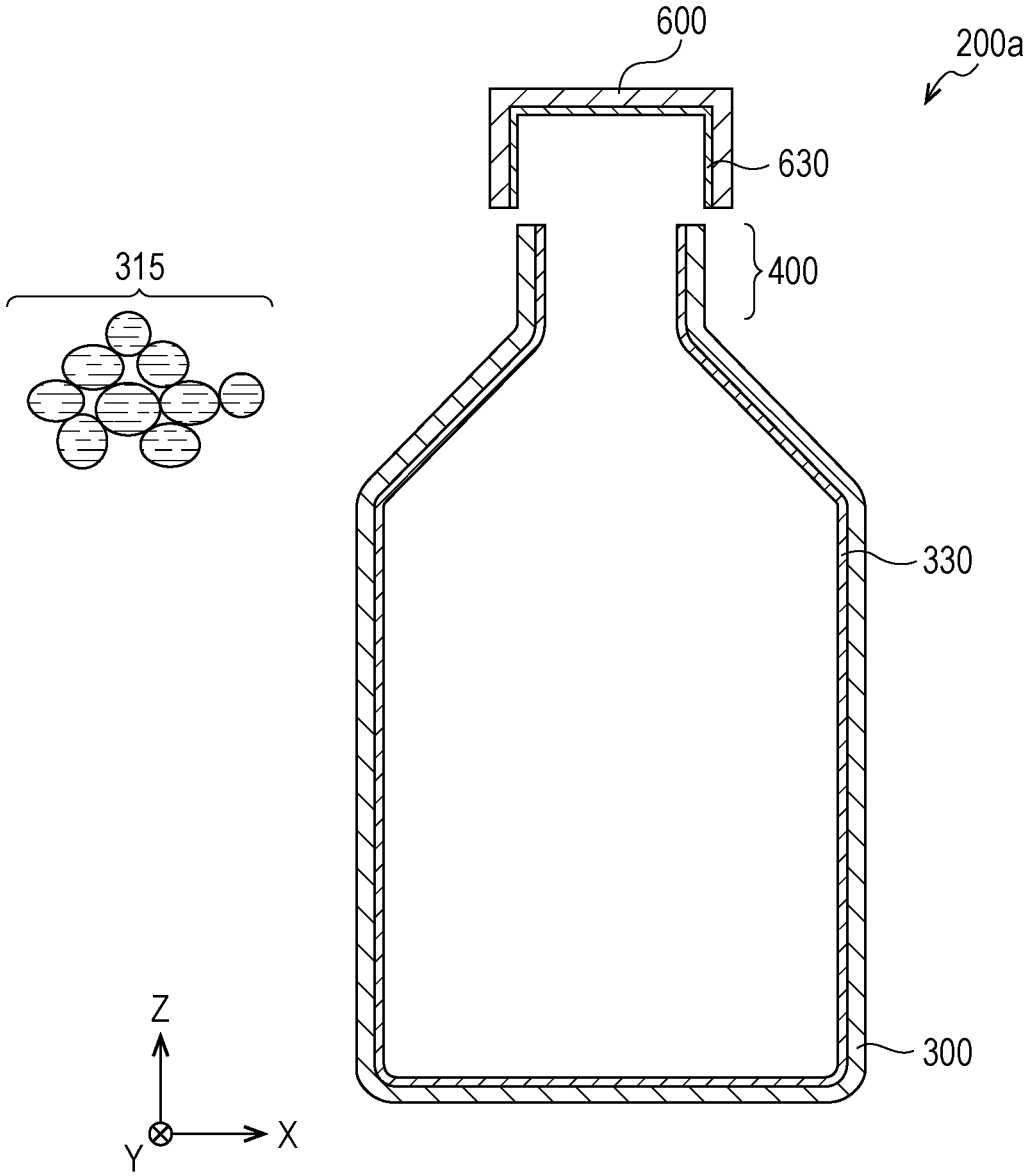
FIG. 13 illustrates an ink supply container from which residual ink is removed.

The cap is removed, and the residual ink 315 is discharged from the container body 300 (process P220). FIG. 13 illustrates the ink supply container 200*a* from which the residual ink 315 is removed. After the residual ink 315 gathered in and nearby the conduit part 400 has been discharged, little residual ink 315 adheres to the ink supply container 200*a*. Accordingly, the used container 200*a* with little residual ink 315 can be reused. In addition, only the residual ink 315 is discarded, and the volume of the component to be discharged can be reduced.

As illustrated in FIG. 11, through the conduit part 400, an ink is introduced into the container body 300 (process P230). The cap 600 is attached to the container body 300 and the processing of reproducing the ink supply container 200*a* is completed.

The ink supply container 200*a* according to the second embodiment is provided with the water-repellent layer 330 on the inner surface of the container body 300 and the inner surface of the conduit part 400. In addition, the water-repellent layer 630 is provided on the inner surface of the cap 600. With the water-repellent layers, in response to an application of a centrifugal force to the dotted residual ink 315, the ink 315 is gathered toward the ink outlet 415. Accordingly, the residual ink 315 can be readily discharged from the container body 300.

In the ink supply container 200*a*, neither of the films 310 and 610 that are attached to the ink supply container 200 according to the first embodiment are provided; accordingly, the volume of the component to be discarded can be reduced.

C. Third Embodiment

Figure 14:
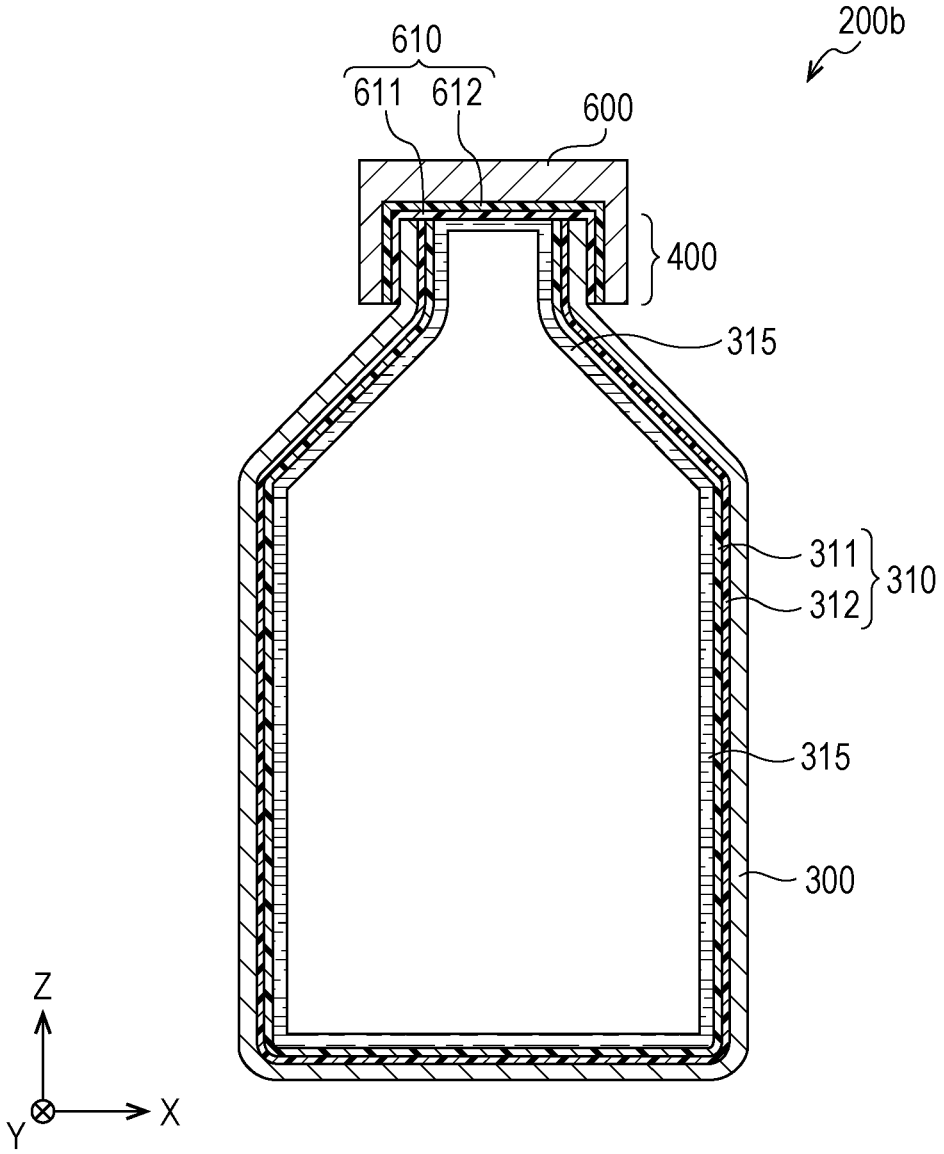
FIG. 14 is a sectional view illustrating a schematic structure of an ink supply container from which an ink has been depleted according to a third embodiment.

FIG. 14 is a sectional view illustrating a schematic structure of an ink supply container 200*b* after use according to a third embodiment. The ink supply container 200*b* according to the third embodiment differs from the ink supply container 200 according to the first embodiment in that the ink supply container 200*b* is provided with a film consisting of a plurality of layered sub-films on the inner surface of the container body 300, the inner surface of the conduit part 400, and the inner surface of the cap 600. Other structures of the ink supply container 200*b* according to the third embodiment are similar to those of the ink supply container 200 according to the first embodiment and thus, the same reference numerals are given to components similar to those in the first embodiment and detailed description thereof is omitted.

As illustrated in FIG. 14, the used container 200*b* according to the third embodiment is provided with a film 310 that includes a first sub-film 311 and a second sub-film 312 to hold an ink. The film 610 includes a first sub-film 611 and a second sub-film 612. The first sub-film 311 and the second sub-film 312 are layered. Similarly, the first sub-film 611 and the second sub-film 612 are layered. The first sub-film 311 is disposed on an inner surface of the second sub-film 312. The first sub-film 611 is disposed on an inner surface of the second sub-film 612. Each time the contained ink is depleted, the innermost sub-film is removed. For example, in a state illustrated in FIG. 14, the innermost first sub-film 311 is pulled out of the container body 300. In this embodiment, accordingly, the number of times of reusing the container body 300 can be limited by the number of films without providing a new film 310 inside the container body 300.

The ink supply container 200*b* according to the third embodiment is provided with the film 310 and the film 610 that are provided on the inner surface of the container body 300 and the inner surface of the conduit part 400, and the cap 600 respectively, and the film 310 includes the layered sub-films 311 and 312, and the film 610 includes the layered sub-films 611 and 612. After the ink contained by the first sub-film 311 on the inner side in the radial direction is depleted, the innermost sub-films 311 and 611 are respectively pulled out of the container body 300 and the cap 600. With this structure, the number of times of reusing the container body 300, the conduit part 400, and the cap 600 can be limited by the number of the films without providing new films inside the container body 300, the conduit part 400, and the cap 600. In addition, the second sub-films 312 and 612 can be newly set by just removing the used first sub-films 311 and 611, increasing the convenience.

D. Other Embodiments

D1. In the above-described embodiments, in the processing of reproducing the ink supply container 200 or the ink supply container 200*a*, the process of forming the water-repellent layers is omitted; however, the present disclosure is not limited to those embodiments. After the completion of the removal process (P110) in FIG. 5 in the first embodiment, and after the completion of the ink discharging process (P220) in FIG. 11 in the second embodiment, a process of forming the water-repellent layers on the inner surface of the container body 300, the inner surface of the conduit part 400, and the inner surface of the cap 600 may be provided.

D2. In the third embodiment, although the number of the sub-films included in the films 310 and 610 is two, the number of the sub-films is not limited to two, and any number of films may be used.

D3. In the first embodiment, the films 310 and 610 are attached to all of the inner surface of the container body 300, the inner surface of the conduit part 400, and the inner surface of the cap 600 respectively; however, the present disclosure is not limited to the embodiment. The films may be attached to one or two of the inner surface of the container body 300, the inner surface of the conduit part 400, and the inner surface of the cap 600.

D4. In the first embodiment, the water-repellent layer is provided between the film 310 and the inner surfaces of the container body 300 and the conduit part 400, and between the film 610 and the inner surface of the cap 600; however, the present disclosure is not limited to the embodiment. No water-repellent layer may be provided between the film 310 and the inner surfaces of the container body 300 and the conduit part 400, and between the film 610 and the inner surface of the cap 600.

D5. In the first embodiment, the films 310 and 610 are attached to all of the inner surfaces of the container body 300 and the conduit part 400 and the inner surface of the cap 600, respectively, and the water-repellent layer is provided between the inner surfaces and the films 310 and 610; however, the present disclosure is not limited to the embodiment. The films may be attached to one or two of the inner surface of the container body 300, the inner surface of the conduit part 400, and the inner surface of the cap 600, and the water-repellent layer may be provided between the one or two inner surfaces on which the film or films are attached and the film or films.

The present disclosure is not limited to the above-described embodiments, and various modifications may be made without departing from the scope of the present disclosure. For example, the present disclosure may be implemented according to the following aspects. The technical features in the above-described embodiments corresponding to the following aspects may be replaced or combined as appropriate to solve some or all of the above-described problems or to achieve some or all of the above-described effects. Unless the technical features are described as essential in this specification, the technical features may be omitted as appropriate.

1. According to an aspect of the present disclosure, an ink supply container is provided. The ink supply container is an ink supply container configured to supply an ink to a printer and includes a container part configured to contain the ink, a conduit part located on a top side of the container part, the conduit part being configured to lead the ink out, a cap configured to protect the conduit part, the cap being detachably attached to the conduit part, and a film attached to at least one of an inner surface of the container part, an inner surface of the conduit part, and an inner surface of the cap. The ink supply container according to the aspect enables removal of the film with adhering residual ink from at least one of the inner surface of the container part, the inner surface of the conduit part, and the inner surface of the cap after the ink is depleted, enabling reuse of at least one of the container part, the conduit part, and the cap to which almost no residual ink adheres. With this structure, the reuse of the ink supply container can be eased and reduction in volume of components to be discarded can be achieved.

2. In the ink supply container according to the aspect, a water-repellent layer may be provided between the film and at least one of the inner surface of the container part, the inner surface of the conduit part, and the inner surface of the cap. In the ink supply container according to the aspect, the film attached to the at least one of the inner surfaces on which the water-repellent layer is provided can be readily stripped.

3. In the ink supply container according to the aspect, the film may be attached to all of the inner surface of the container part, the inner surface of the conduit part, and the inner surface of the cap. The ink supply container according to the aspect enables removal of the film with adhering residual ink from the inner surface of the container part, the inner surface of the conduit part, and the inner surface of the cap after the ink is depleted, enabling reuse of the container part, the conduit part, and the cap with almost no residual ink. With this structure, the reuse of the ink supply container can be eased and reduction in volume of the components to be discarded can be further enhanced.

4. In the ink supply container according to the aspect, the film may include a plurality of sub-films that are layered. In the ink supply container according to the aspect, the number of times of reusing the container part, the conduit part, and the cap can be limited by the number of the films without providing new films inside the container part, the conduit part, and the cap. In addition, the second sub-films can be newly set by just removing the used first sub-films, increasing the convenience.

5. According to another aspect, a method of reproducing the ink supply container may include preparing the ink supply container from which the ink is depleted through ink supply, blowing air between the film and at least one of the inner surface of the container part, the inner surface of the conduit part, and the inner surface of the cap to peel off and remove the film, attaching a new film to at least one of the inner surface of the container part, the inner surface of the conduit part, and the inner surface of the cap, and introducing a new ink into the container part through the conduit part. According to the aspect, the ink supply container can be reproduced.

6. According to another aspect, an ink supply container configured to supply an ink to a printer may include a container part configured to contain the ink, a conduit part located on a top side of the container part, the conduit part being configured to lead the ink out, and a cap configured to protect the conduit part, the cap being detachably attached to the conduit part, in which a water-repellent layer may be provided on an inner surface of the container part, an inner surface of the conduit part, and an inner surface of the cap. In the ink supply container according to the aspect, only the residual ink is discarded, and the volume of the component to be discarded can be further reduced.

7. According to another aspect, a method of reproducing the ink supply container may include preparing a used container that is the ink supply container from which the ink is depleted through ink supply, setting the used container in a centrifuge such that the conduit part faces outward in a radial direction of a rotor in a state in which the cap is attached to the conduit part, and applying a centrifugal force, removing the cap and discharging the ink remaining in the container part, and providing a new ink into the container part through the conduit part. According to the aspect, the ink supply container can be reproduced.

What is claimed is:

1. An ink supply container configured to supply an ink to a printer, the ink supply container comprising:

a container part configured to contain the ink;

a conduit part located on a top side of the container part, the conduit part being configured to lead the ink out;

a cap configured to protect the conduit part, the cap being detachably attached to the conduit part; and a film that is provided on at least one of an inner surface of the container part, an inner surface of the conduit part, and an inner surface of the cap, wherein the film is provided on all of the inner surface of the container part, the inner surface of the conduit part, and the inner surface of the cap.

2. The ink supply container according to claim 1, wherein a water-repellent layer is provided between the film and at least one of the inner surface of the container part, the inner surface of the conduit part, and the inner surface of the cap.

3. The ink supply container according to claim 1, wherein the film includes a plurality of sub-films that are layered.

4. A method of remanufacturing an ink supply container that includes a container part configured to contain ink, a conduit part located on a top side of the container part and configured to lead the ink out, a cap configured to protect the conduit part and being detachably attached to the conduit part, and a film that is provided on at least one of an inner surface of the container part, an inner surface of the conduit part, and an inner surface of the cap, the method comprising:

preparing the ink supply container from which the ink is depleted through ink supply to the printer;

blowing air between the film and at least one of the inner surface of the container part, the inner surface of the conduit part, and the inner surface of the cap to peel off and remove the film;

attaching a new film to at least one of the inner surface of the container part, the inner surface of the conduit part, and the inner surface of the cap; and introducing a new ink into the container part through the conduit part.

5. An ink supply container configured to supply an ink to a printer, the ink supply container comprising:

a container part configured to contain the ink;

a conduit part located on a top side of the container part, the conduit part being configured to lead the ink out; and a cap configured to protect the conduit part, the cap being detachably attached to the conduit part, wherein a water-repellent layer is provided on an inner surface of the container part, an inner surface of the conduit part, and an inner surface of the cap.

6. A method of reproducing the ink supply container according to claim 5, the method comprising:

preparing a used container that is the ink supply container from which the ink is depleted through ink supply to the printer;

setting the used container in a centrifuge such that the conduit part faces outward in a radial direction of a rotor in a state in which the cap is attached to the conduit part, and applying a centrifugal force;

removing the cap and discharging the ink remaining in the container part; and introducing a new ink into the container part through the conduit part.

* * * * *